US008662044B2

(12) United States Patent
Becker et al.

(10) Patent No.: US 8,662,044 B2
(45) Date of Patent: Mar. 4, 2014

(54) FUEL SYSTEM ELECTRIC PRIMER

(75) Inventors: James D. Becker, Livonia, MI (US); Kevin Smith, Troy, MI (US); Syed Arif Imam, Ontario (CA)

(73) Assignee: Bosch Automotive Service Solutions LLC, Warren, MI (US)

( * ) Notice: Subject to any disclaimer, the term of this patent is extended or adjusted under 35 U.S.C. 154(b) by 582 days.

(21) Appl. No.: 12/963,191

(22) Filed: Dec. 8, 2010

(65) Prior Publication Data

US 2012/0145108 A1 Jun. 14, 2012

(51) Int. Cl.
*F02M 63/02* (2006.01)

(52) U.S. Cl.
USPC ..... 123/179.3

(58) Field of Classification Search
USPC ..... 123/179.7, 179.9, 179.11, 179.16, 123/179.17, 455, 468, 469; 73/114.38, 73/114.41, 114.43
See application file for complete search history.

(56) References Cited

U.S. PATENT DOCUMENTS

| | | | | |
|---|---|---|---|---|
| 4,602,599 | A * | 7/1986 | Glagola | 123/179.9 |
| 5,386,721 | A * | 2/1995 | Alvizar | 73/114.42 |
| 5,664,532 | A * | 9/1997 | August | 123/179.11 |
| 6,305,357 | B1 * | 10/2001 | Soukeras | 123/495 |
| 7,108,026 | B2 * | 9/2006 | Luca | 141/231 |

* cited by examiner

*Primary Examiner* — Stephen K Cronin
*Assistant Examiner* — Arnold Castro
(74) *Attorney, Agent, or Firm* — Baker & Hostetler LLP

(57) ABSTRACT

An electric fuel system primer is provided that is capable of generating enough pressure to open a valve in an engine's fuel system in order for the primer to prime the engine. The primer can include an electric fuel pump that is capable of generating at least 70 p.s.i. or more in order to open the valve. The primer may be powered by the vehicle's battery, by an internal battery or by converting AC to DC or vice versa.

17 Claims, 2 Drawing Sheets

FUEL SYSTEM ELECTRIC PRIMER

FIELD OF THE INVENTION

The present invention relates generally to a fuel system primer. More particularly, the present invention relates to fuel system electric primer that generates enough pressure to open an internal safety valve of a fuel system to prime an engine.

BACKGROUND OF THE INVENTION

Diesel engines are commonly used in large vehicles such as trains, tractors, trucks, and buses due to their efficiencies over regular gasoline engines. The diesel engines often require priming of the fuel system after the engine has been serviced or over hauled. Certain amount fuel pressure is required to open the safety valve in the fuel system so that fuel may reach the engine in order for the engine to start. Currently the priming pressure created by hand pumping or other pressure creating system is too low for proper priming of the diesel engine. This leads to the technician having to crank the engine over and over until enough pressure is created to open the valve. The continuous cranking of the engine potentially wears out the starter and the battery thus adding to the maintenance costs of the vehicle. Thus, it is desirable to provide a fuel system primer that can provide enough pressure to prime the fuel pump.

SUMMARY OF THE INVENTION

The foregoing needs are met, to a great extent, by the present invention, wherein in one aspect an apparatus is provided that in some embodiments include a electric fuel system primer that can overcome the safety valve of a engine's fuel system in order to prime the engine. The electric fuel system primer can be configured to use the battery of the vehicle.

In accordance with one embodiment of the present invention, a fuel system primer is provided, which can include a fuel tank adapter configured to mate with an external fuel tank to retrieve a fuel, a fuel filter configured to filer contaminants that may be in the fuel, a fuel pump configured to pressurized the fuel to a predetermined pressure that will open a valve in a fuel system of an engine of a vehicle, a plurality of battery clamps to clamp to a battery of the vehicle and provide power to the fuel pump, a gauge to measure the pressurized fuel, and an engine adapter configured to prove a connection to the fuel system.

In accordance with another embodiment of the present invention, a method of priming an engine is provided, which can include connecting a fuel tank adapter of a fuel system primer to an external fuel tank, powering the components of the primer with a power source, withdrawing a fuel from the external fuel tank with a fuel pump, filtering the fuel with an fuel filter to remove contaminants from the fuel, pressuring the fuel to a predetermined pressure with the fuel pump, connecting an engine adapter of the fuel system primer with a fuel system of the vehicle, and priming the fuel system of the vehicle.

In accordance with yet another embodiment of the present invention, a fuel system primer is provided, which can include a fuel tank adapting means configured to mate with an external fuel tank to retrieve a fuel, a filtering means configured to filer contaminants that may be in the fuel, a pumping means configured to pressurized the fuel to a predetermined pressure that will open a valve in a fuel system of an engine of a vehicle, a powering means to clamp to a battery of the vehicle and provide power to the pumping means, a gauging means configured to gauge the pressurized fuel, and an engine adapting means configured to prove a connection to the fuel system.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
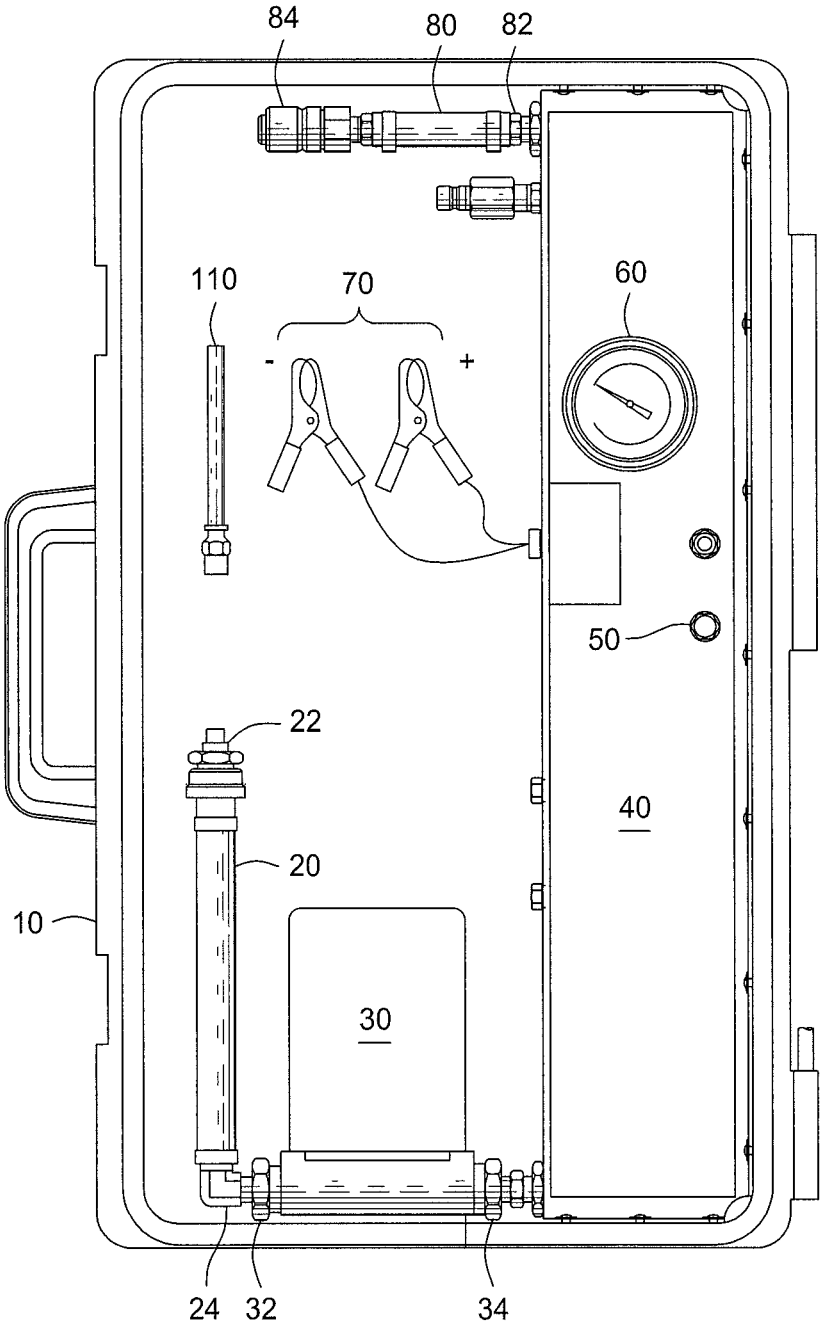
FIG. 1 illustrates an electric fuel system primer according to an embodiment of the invention.

The invention will now be described with reference to the drawing figures, in which like reference numerals refer to like parts throughout. An embodiment in accordance with the present invention provides an electric fuel system primer that is capable of generating the necessary pressure to prime the fuel system of an engine. The engine may be any conventional engine including diesel engines. Diesel engines have a safety valve that requires a certain pressure in order to open and when the valve is opened allows access to parts of the rest of the fuel system.

FIG. 1 illustrates an electric fuel system primer 10 according to an embodiment of the invention. The main components of the primer 10 includes a fuel tank adapter 20, a fuel filter 30, a cover 40, a power button 50, a gauge 60, battery clamps 70, engine connector 80, an electrical connector 90, a fuel pump 100, fuel tank adapter extender 110 and a fuel system adapter 160. These major components can be housed in case 150. The case can be constructed from any material including a polymer, aluminum, tin and the like. The case allows the user to carry the primer 10 to each vehicle that is being serviced.

The fuel tank adapter 20 includes a first end 22, a second end 24 with a hose therein between. The first end 22 is constructed and arranged to connect to an external fuel source, such as a fuel tank (not shown). The first end 22 can be a quick disconnect or another connection type desired. The fuel tank supplies the fuel (i.e. diesel fuel) that is required to prime the engine fuel system. The second end 24 connects to a first end 32 of the fuel filter 30. The second end 24 is a rotatable end of the fuel tank adapter 20 and allows the fuel tank adapter 20 to rotate about an axis of the first end 32 of the fuel filter 30 and/or extend from the first end 32. By being rotatable, the fuel tank adapter can communicate with the fuel tank at various angles, if needed. Further, since the fuel tank adapter 20 can extend from the primer 10, it will be easier to get fuel from the tank. The fuel tank adapter extender 110 is provided to create a better connection between the fuel tank and the fuel tank adapter. The fuel tank adapter extender 110 includes a long portion for inserting into the fuel tank to access fuel that may be at the bottom of the tank.

The fuel filter 30 includes the first end 32 that connects to the second end 24 of the fuel tank adapter 20 and a second end 34 that connects to a hose 120 of the fuel pump 100. The fuel filter 30 is constructed and arranged to filter any contaminants in the fuel including water. Filtering the fuel of contaminants will prevent the fuel pump 100 (FIG. 2) from clogging up and prevent the introduction of contaminants into the engine and causing damage to it. The fuel filter 30 is replaceable for easy maintenance. The fuel filter 30 may include a sensor that senses the amount of fuel that has been filtered so as to alert the user to change the filter once a predetermined amount of fuel has passed there through.

FIG. 1 illustrates the cover 40 that houses the fuel pump 100 and additional components of the primer 10. The cover may be made of any material including steel, tin, aluminum, plastic and any other materials that can protect the pump and various electrical connectors therein. The cover also includes on its surface the power switch 50, which can be a toggle switch or a simple on/off button. Although the cover houses a portion of the components of the primer 10, it may cover additional components as needed. The cover 40 is removable for access to the components for servicing and maintenance.

Figure 2:
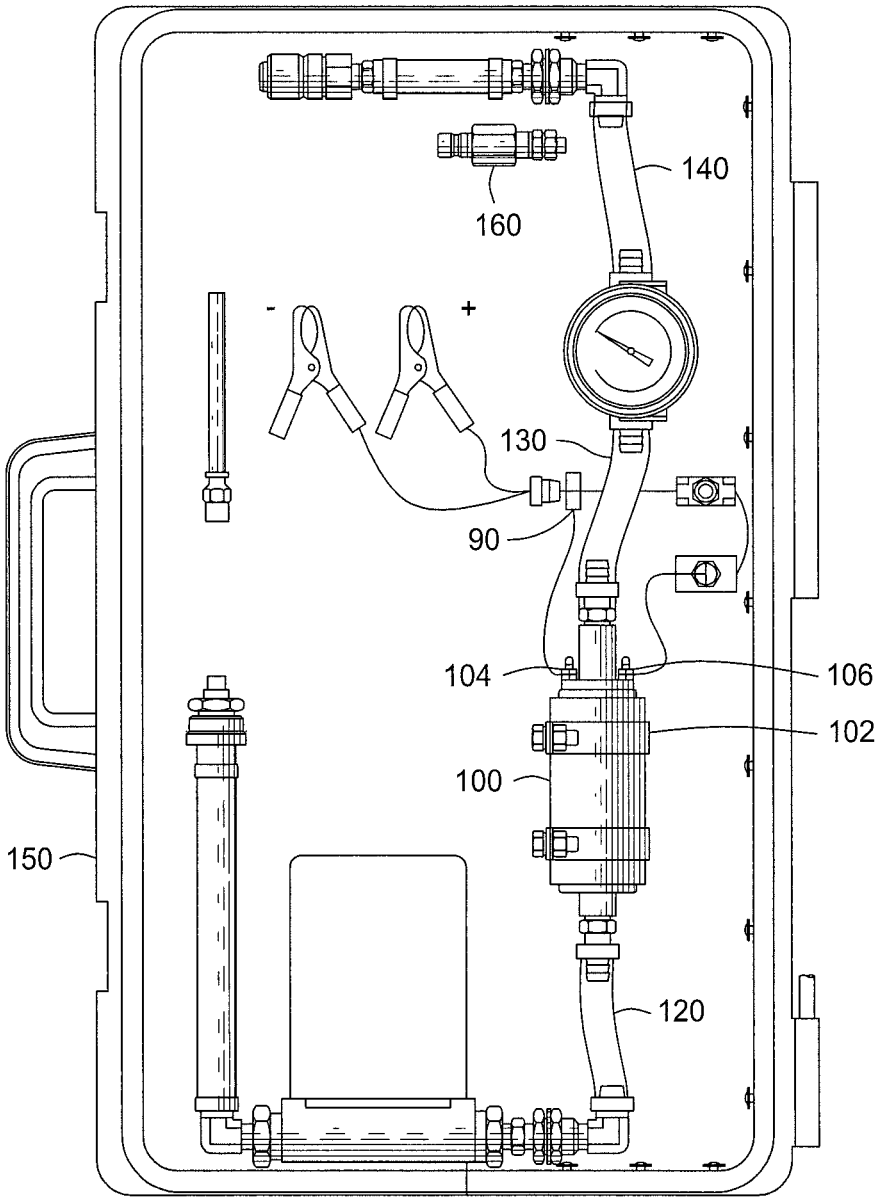
FIG. 2 illustrates the primer of FIG. 1 with the cover removed according to an embodiment of the invention.

FIG. 2 illustrates the primer 10 with the cover 40 removed. As shown, the hose 120 connects the fuel filter 30 with the fuel pump 100. The hose can include its own fittings to connect with the fuel filter 30 and the fuel pump 100 or may simply connect to the hose fitting that is part of the fuel filter and the fuel pump. The hose 120 provides fluid communication between the fuel filter 30 and the fuel pump 100. The hose may be clear so that any contaminants in the fuel may be viewed.

The fuel pump 100 is constructed and designed to provide enough pressure to the engine fuel system to overcome the safety valve (not shown) in the engine fuel system on order to prime the engine. One example of a pump is the Walbro Pump Model No. WX-7144. The pressure generated may range from 5 p.s.i to 100 p.s.i. In other embodiments, the pump generate pressures of less than 5 p.s.i. or more than 100 p.s.i. depending on the need of the user. At a minimum, the fuel pump 100 provides enough pressure to overcome the internal safety valve of the engine fuel system in order to prime the engine. As discussed below, the fuel pump 100 is powered by several different ways.

One way to power the fuel pump 100 is through a connection with the vehicle's battery. Battery clamps 70 with their positive and negative connections can be connected to the respective posts of the vehicle's battery. The battery's positive and negative connections are connected correspondingly to negative connector 104 and positive connector 106 on the fuel pump 100. In an alternative embodiment, the primer 10 can be powered by AC or DC current. In this embodiment, a converter 90 may be placed in line with the battery clamp connections or can substitute for the battery clamps themselves in order for the conversion needed to use AC or DC. Such convertor may be a CHB 150 W-24S12 converter from CINCON Electronics CO., LTD. of Taiwan. The convertor also allows for use of the primer in countries with 120V such as the United States and 240V such as in Europe. By having one or both of the ways to power the primer 10, the primer 10 offers the flexibility needed to tap into the available power sources. In still another embodiment, the primer 10 may be provided with its own internal battery source. In another embodiment, the battery clamps may be replaced with or have in addition to a cigarette lighter adapter that draws power from the vehicle's battery.

The fuel pump 100 can be held in place by holder 102. The holder 102 is constructed and designed to hold the fuel pump 100 in place during pumping. The holder 102 may be bolted or coupled with the case 150 as needed.

A hose 130 provides fluid communication between the fuel pump 100 and the gauge 60. The hose 130 can include its own fittings to connect with the gauge 60 and the fuel pump 100 or may simply connect to the hose fitting that is part of the gauge and the fuel pump. The hose 130 provides fluid communication between the gauge 30 and the fuel pump 100. The hose 130 may be clear so that any contaminants in the fuel may be viewed.

The gauge 60 indicates the pressure of the fuel created by the fuel pump 100. This allows the user to know if sufficient pressure has been created in order to overcome the internal safety valve of the engine fuel system and prime the engine fuel system. The gauge 60 can be a mechanical or electrically driven gauge. The pressure may also be shown on a digital display having the necessary processor or controller.

A hose 140 (similar to other hoses described herein) provides fluid communication between the gauge 60 and the engine connector 80. The engine connector 80 includes a first end 84 to connect to the engine fuel system being primed and a second end 82 to connect to hose 140. The first end 84 is constructed and arranged to couple with the engine fuel system. The first end may include a quick disconnect coupler that allows for easy and quick connection to the engine fuel system. The second end 82 may be rotatable for better mating with the engine fuel system. A connector 160 can be used to couple the primer with other engine fuel system depending on the fitting required.

In operation, the primer 10 can be connected to the external fuel tank via the fuel tank adapter 20 and to the desired power source. The power source may be the battery of the vehicle whose engine is being primed, an internal battery or AC or DC current via an electric outlet. The fuel pump 100 can draw the fuel from the external tank into the primer 10. The fuel flows through the fuel tank adapter 20 and the fuel filter 30. The fuel filter 30 will filter the fuel to remove any contaminants. After the fuel filter 30, the fuel enters the pump where the fuel pressure can be increased to 70 p.s.i. or more depending on the safety valve of engine's fuel system. Of course, the primer can create more or less pressure as needed by the user in order to prime the engine. The gauge indicates if the desired pressure is being achieved by the fuel pump. After leaving the gauge, the pressurized fuel will flow through the engine connector 80 and into the engine fuel system. With adequate pressure overcoming the safety valve in the engine fuel system, the engine will start relatively quickly. By having a self contained primer that can use the battery of the vehicle being serviced, the primer can be used without having the search for a power plug. This also allows for service to be conducted outside of a garage and can be done in the field. Further, with the use of the primer, the technician does not have to wear out the starter or other engine starting components that will lead to increase service costs to the customer.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. An electrical fuel system primer, comprising:

a fuel tank adapter configured to mate with an external fuel tank to retrieve a fuel;

a fuel filter configured to filter contaminants in the fuel;

a fuel pump configured to pressurized the fuel to a predetermined pressure that will open a valve in a fuel system of a vehicle;

a plurality of battery clamps to clamp to a battery of the vehicle and provide power to the fuel pump;

a gauge to measure the pressurized fuel;

a converter configured to step up or step down a current as needed; and an engine adapter configured to provide a connection to the fuel system.

2. The primer of claim 1 further comprising:

a first hose having one end coupled to the fuel pump and the other end to the fuel filter;

a second hose having one end coupled to the fuel pump and the other end to the gauge; and a third hose having one end coupled to the gauge and the other end to the engine adapter.

3. The primer of claim 2, wherein the hoses are clear so that the fuel is viewable.

4. The primer of claim 1, wherein the gauge is digital.

5. The primer of claim 1, wherein the converter is also configured to convert AC to DC and vice versa.

6. The primer of claim 1 further comprising a housing that contains the fuel tank adapter, the fuel filter, the fuel pump, the plurality of battery clamps, the gauge and the engine adapter.

7. The primer of claim 1 further comprising a fuel system adapter configured to couple with the engine adapter in order for the primer to communicate with the fuel system.

8. The primer of claim 1 further comprising a fuel tank adapter extender configured to couple with the fuel tank adapter in order to retrieve fuel from the external fuel tank.

9. A method of priming an engine, comprising the steps of:

connecting a fuel tank adapter of an electrical fuel system primer to an external fuel tank;

powering components of the electrical fuel system primer with a power source, wherein powering the components further comprising using a converter to step up or step down a voltage;

withdrawing a fuel from the external fuel tank with a fuel pump;

filtering the fuel with a fuel filter to remove contaminants from the fuel;

pressuring the fuel to a predetermined pressure with the fuel pump;

connecting an engine adapter of the electrical fuel system primer to a fuel system of the vehicle; and priming the fuel system of the vehicle.

10. The method of claim 9, wherein the power source is provided by connecting to a vehicle's battery via battery clamps connected to the primer.

11. The method of claim 9, wherein powering the components further comprising using the converter to convert AC to DC and vice versa.

12. An electrical fuel system primer, comprising:

a first means for adapting configured to mate with an external fuel tank to retrieve a fuel;

means for filtering configured to filter contaminants in the fuel;

means for pumping configured to pressurized the fuel to a predetermined pressure that will open a valve in a fuel system of a vehicle;

means for powering configured to clamp to a battery of the vehicle and provide power to the means for pumping;

means for gauging configured to gauge the pressurized fuel;

means for converting power configured to step up or step down a current as needed; and a second means for adapting configured to provide a connection to the fuel system.

13. The primer of claim 12 further comprising:

a first means for transferring having one end coupled to the means for pumping and the other end to the means for filtering;

a second means for transferring having one end coupled to the means for pumping and the other end to the means for gauging; and a third means for transferring having one end coupled to the means for gauging and the other end to the engine means for adapting.

14. The primer of claim 13, wherein the means for transferring are clear so that the fuel is viewable.

15. The primer of claim 12, wherein the means for converting power is also configured to convert AC to DC and vice versa.

16. The primer of claim 12 further comprising a fuel system adapter configured to couple with the second means for adapting in order for the primer to communicate with the fuel system.

17. The primer of claim 12 further comprising a fuel tank adapter extender configured to couple with the first means for adapting in order to retrieve fuel from the external fuel tank.

* * * * *